US009872118B2

(12) United States Patent
Bothe et al.

(10) Patent No.: US 9,872,118 B2
(45) Date of Patent: Jan. 16, 2018

(54) METHOD AND DEVICE FOR IDENTIFYING THE POSITION OF LOUDSPEAKER BOXES IN A LOUDSPEAKER BOX ARRANGEMENT

(71) Applicant: d&b audiotechnik GmbH, Backnang (DE)

(72) Inventors: Frank Bothe, Backnang (DE); Matthias Christner, Ludwigsburg (DE); Fabian Braun, Fellbach (DE)

(73) Assignee: D&B AUDIOTECHNIK GMBH, Backnang (DE)

( * ) Notice: Subject to any disclaimer, the term of this patent is extended or adjusted under 35 U.S.C. 154(b) by 0 days.

(21) Appl. No.: 15/133,469

(22) Filed: Apr. 20, 2016

(65) Prior Publication Data

US 2016/0337772 A1 Nov. 17, 2016

(30) Foreign Application Priority Data

Apr. 21, 2015 (DE) ..... 10 2015 106 114

(51) Int. Cl.
*H04R 29/00* (2006.01)
*H04S 7/00* (2006.01)

(52) U.S. Cl.
CPC ..... *H04R 29/002* (2013.01); *H04S 7/00* (2013.01); *H04R 2201/403* (2013.01); *H04R 2205/024* (2013.01); *H04R 2430/20* (2013.01)

(58) Field of Classification Search
CPC ..... H04S 7/00; H04R 2205/024; H04R 2201/028; H04R 2430/00; H04R 2430/23; H04R 25/305; H04R 9/06
See application file for complete search history.

(56) References Cited

U.S. PATENT DOCUMENTS 8,270,620 B2 9/2012 Christensen
2001/0038702 A1* 11/2001 Lavoie ..... H04S 7/301 381/307
2003/0179891 A1* 9/2003 Rabinowitz ..... H04S 7/307 381/103
2010/0135118 A1 6/2010 Van Leest et al.
2010/0272270 A1* 10/2010 Chaikin ..... H04R 29/008 381/59
2012/0221329 A1* 8/2012 Harsch ..... H04R 3/02 704/225

(Continued)

FOREIGN PATENT DOCUMENTS

EP 1443804 A2 8/2004

OTHER PUBLICATIONS

German Office Action cited in DE Application No. 102015106114.7 dated Oct. 13, 2015, pp. 1-10.

*Primary Examiner* — Mohammad Islam
(74) *Attorney, Agent, or Firm* — Cooper Legal Group, LLC

(57) ABSTRACT

A method for identifying the position of loudspeaker boxes in a loudspeaker box arrangement includes the operation of a first loudspeaker box in the loudspeaker box arrangement as an acoustic test signal generator. An acoustic test signal from the first loudspeaker box is received at other loudspeaker boxes in the loudspeaker box arrangement. A positional relationship between the signal-generating first loudspeaker box and at least one of the other loudspeaker boxes in the loudspeaker box arrangement is ascertained on the basis of the acoustic test signal received in the other loudspeaker boxes.

12 Claims, 5 Drawing Sheets

(56) References Cited

U.S. PATENT DOCUMENTS

| | | | | |
|---|---|---|---|---|
| 2014/0022084 | A1* | 1/2014 | Drimusz | H04R 29/001 340/636.2 |
| 2015/0271616 | A1* | 9/2015 | Kechichian | H04R 3/02 381/58 |
| 2016/0061597 | A1* | 3/2016 | De Bruijn | |

* cited by examiner

METHOD AND DEVICE FOR IDENTIFYING THE POSITION OF LOUDSPEAKER BOXES IN A LOUDSPEAKER BOX ARRANGEMENT

TECHNICAL FIELD

Embodiments described herein generally relate to a method, a device and a computer program product for identifying the position of loudspeaker boxes in a loudspeaker box arrangement and to an audio signal processing system that is able to carry out the identification of the position of loudspeaker boxes in a loudspeaker box arrangement.

BACKGROUND

Public address for auditoria frequently involves the use of loudspeaker box arrangements that contain multiple grouped loudspeaker boxes. By way of example, so-called line arrays are known, in which a plurality of loudspeaker boxes are arranged essentially vertically below one another.

DESCRIPTION OF EMBODIMENTS

Figure 1:
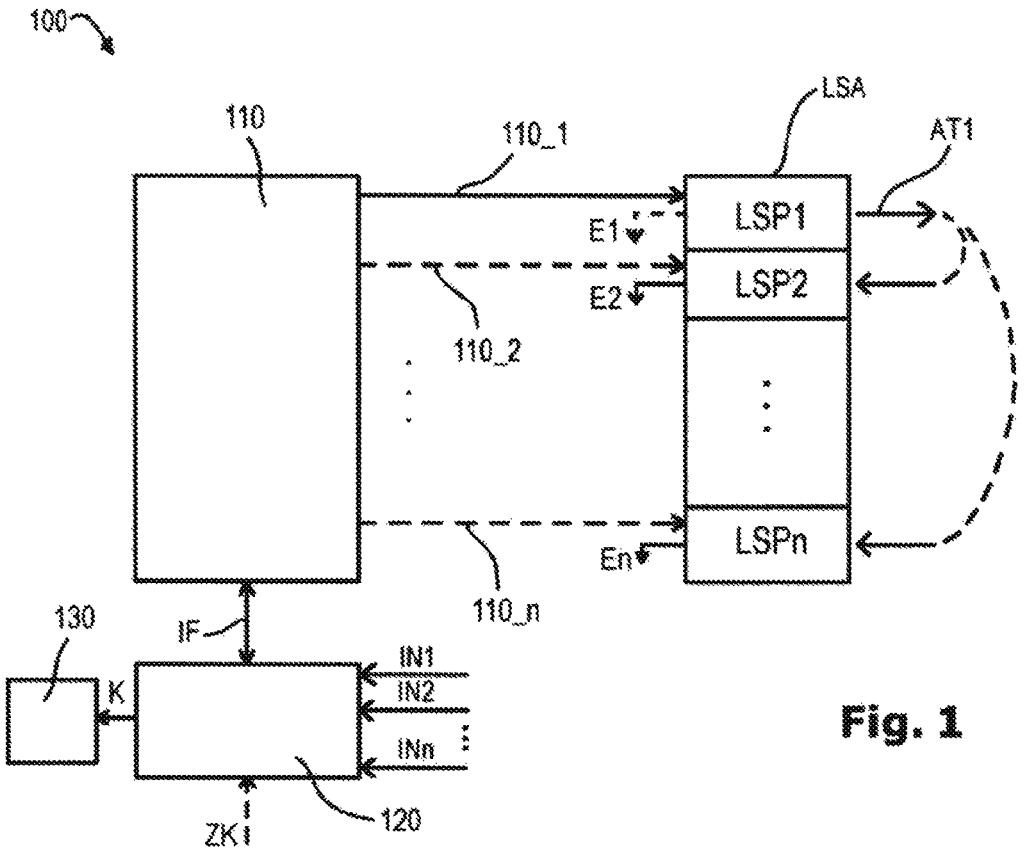
FIG. 1 is a schematic block diagram of an exemplary device for identifying the position of loudspeaker boxes in a loudspeaker box arrangement.

Exemplary embodiments are explained by way of example below with reference to the figures of the drawings. The same reference symbols denote mutually corresponding or similar parts. In addition, the features and functionalities explained with reference to the various figures can be combined with one another, even if this is not expressly indicated below. By nature, the exemplary embodiments describe details or specific refinements that are optional or can be implemented in another way and can therefore—particularly also when features of different exemplary embodiments are combined—be dispensed with.

When loudspeaker boxes in such a loudspeaker box arrangement are operated with individual signal processing, it may be desirable or necessary to know the positions of the loudspeaker boxes in the loudspeaker box arrangement (e.g. the line array) so that the association between the signal processing items and the loudspeaker boxes is correct. Specifically in the case of mobile public address systems, what are known as touring systems, it is desirable to be able to easily check and if need be correct the association between the individual signal processing items and the positions of the loudspeaker boxes (which association may also be prescribed by the cabling between the audio signal processing system and the loudspeaker box arrangement, for example). In the event of erroneous association and/or erroneous cabling in which, by way of example, the signal processing that is provided for the loudspeaker box in the top position in the line array is delivered to a loudspeaker box in another position (e.g. in the center of the line array), the central loudspeaker box is operated with signal processing that is provided for the top loudspeaker box, which can seriously impair the quality of the public address in the auditorium at least locally.

Therefore, a method may be desirable to identify the position of loudspeaker boxes in a loudspeaker box arrangement that is simple to perform and has low complexity in terms of design requirements. In addition, a device and a computer program product for identifying the position of loudspeaker boxes in a loudspeaker box arrangement may be desirable. Further, an audio signal processing system that allows the position of loudspeaker boxes in a loudspeaker box arrangement to be identified easily and inexpensively, particularly without complex additional design requirements, would be beneficial.

An exemplary embodiment of a method for identifying the position of loudspeaker boxes in a loudspeaker box arrangement comprises the operation of a first loudspeaker box in the loudspeaker box arrangement as an acoustic test signal generator. The acoustic test signal from the first loudspeaker box is then received at other loudspeaker boxes in the loudspeaker box arrangement. The acoustic test signal received in the other loudspeaker boxes can be taken as a basis for ascertaining a positional relationship between the signal-generating first loudspeaker box and at least one of the other loudspeaker boxes in the loudspeaker box arrangement.

The method can be used to perform identification of the position of the loudspeaker boxes in the loudspeaker box arrangement by means of a test mode for the loudspeaker boxes and use of the (other) loudspeaker boxes as test signal receivers. Since identification of the position involves the use of an acoustic test signal that, by nature, can be generated and if need be also received by the loudspeakers in the loudspeaker boxes themselves, it is not necessary to provide devices based on other principles, such as proximity detectors or infrared sensors fitted to the tops and bottoms of the loudspeaker boxes, or the like, for example.

By way of example, the loudspeakers in the other loudspeaker boxes can be used as receivers of the acoustic test signal. In this case, it is possible for no kind of design alterations or additions to the loudspeaker boxes to be provided in order to be able to carry out the method for position identification. In particular, loudspeaker box arrangements from any manufacturer and of any type can be used. That is to say that the method for identifying the position of the loudspeaker boxes in the loudspeaker box arrangement makes no particular compatibility demands on the loudspeaker box arrangement and the device carrying out the method, e.g. an audio signal processing system that is set up for carrying out the method.

One simple option for performing the method involves the received acoustic test signal being subjected to a respective level measurement and the positional relationship between the signal-generating first loudspeaker box and the at least one of the other loudspeaker boxes being ascertained on the basis of a level comparison. Since audio signal processing systems may already include level measurement, e.g. at the outputs of the power amplifiers, the method provides a simple way of merely accessing the (existent) measured level values in order to perform the identification of the position of the loudspeaker boxes in the loudspeaker box arrangement.

It is likewise possible, if need be in combination with the aforementioned method, for the received acoustic test signal to be subjected to a respective propagation time measurement and for the positional relationship between the signal-generating first loudspeaker box and the at least one of the other loudspeaker boxes to be ascertained on the basis of a comparison of the measured propagation times.

Depending on the number of loudspeaker boxes in the loudspeaker box arrangement and/or possibly existent additional knowledge about one or more particular loudspeaker box positions or positional relationships between individual loudspeaker boxes and/or the evaluation of the received acoustic test signals that is used in the method, provision may be made (and in practice it also ought to be the rule) for the method to be continued by operating a second loudspeaker box in the loudspeaker box arrangement as an acoustic test signal generator. As a result, it is possible for further positional relationships between the (new) signal-generating second loudspeaker box and at least one of the other loudspeaker boxes in the loudspeaker box arrangement to be ascertained on the basis of the acoustic test signal that is now emitted by the second loudspeaker box. It is thus possible for one, a plurality or possibly all of the loudspeaker boxes in the loudspeaker box arrangement to be operated as (an) acoustic test signal generator(s) in order to obtain possibly complete information about the positions of the loudspeaker boxes in the loudspeaker box arrangement.

It is pointed out that the terms "position" and "identification of the position" in the present document have a broad meaning that is intended to cover both the meaning of the "relative position" and that of the "absolute position". That is to say that identification of position within the context of the disclosure herein has already been effected if a positional relationship between at least two loudspeaker boxes has been identified, i.e. if e.g. at least two adjacent loudspeaker boxes have been identified or—furthermore—the order of at least three and possibly all loudspeaker boxes in the loudspeaker box arrangement has been ascertained.

For some applications of the method, it may be sufficient to ascertain a relative position (i.e. at least a single positional relationship between two loudspeaker boxes), for example in order to check the loudspeaker cabling for a particular, possibly transposed cable connection or in order to verify the two loudspeaker boxes that must not be arranged adjacently are actually not so. For other applications, it is necessary to ascertain not only the relative positions but also the absolute positions of the loudspeaker boxes in the loudspeaker box arrangement. Normally, knowledge of the order (which corresponds to complete knowledge of all the relative positions) of the loudspeaker boxes can be used to infer the absolute positions of all of the loudspeaker boxes in the loudspeaker box arrangement by virtue of additional knowledge of a single absolute position (e.g. the knowledge of which of the loudspeaker boxes is the top loudspeaker box in the loudspeaker box arrangement). By way of example, this additional knowledge may be available as "a priori" knowledge before the method is actually performed, or it may also be obtained only thereafter—for example if the order of the loudspeaker boxes in the loudspeaker box arrangement has already been ascertained according to the various embodiments described herein but it is not yet certain which of the two ascertained outer loudspeaker boxes is the top or the bottom loudspeaker box in the loudspeaker box arrangement.

When the positions of the loudspeaker boxes in the loudspeaker box arrangement have been ascertained, the loudspeaker boxes can be allocated logical addresses for a multichannel audio signal processing item in accordance with their identified positions. Since each channel of a multichannel audio signal processing item is intended for precisely one (absolute) loudspeaker box position in the loudspeaker box arrangement, the logical addresses can be taken as a basis for checking the existing association (e.g. prescribed by the cabling or otherwise) and if need be correcting it by means of readdressing and/or changing the cabling. If, by way of example, provision is made for the first, second, . . . , k-th channel of an audio signal processing item to be intended for the first, second, . . . , k-th loudspeaker box position, as counted from top to bottom, in a line array, then it is possible to check whether this intended association corresponds to the actual association between the channels and the loudspeaker box positions and, if transposition has taken place in the association, for example, this transposition can be corrected by means of an appropriate change in the logical addressing of the channels and/or an appropriate change in the cabling.

It is also possible for microphones to be used in the loudspeaker boxes, which microphones are used as receivers of the acoustic test signal. In exchange, any microphones that are already present in the loudspeaker boxes for other purposes (e.g. self-diagnosis) can be employed in a new use. The microphones can then be used as receivers instead of the loudspeakers and—normally with better sensitivity and resolution than the (dynamic) loudspeakers in the loudspeaker box arrangement—can receive the acoustic test signals and produce a corresponding received signal.

A device for identifying the position of loudspeaker boxes in a loudspeaker box arrangement can have a device for bringing about a test mode for a first loudspeaker box in the loudspeaker box arrangement by emitting an acoustic test signal, and an evaluation device that is configured to take received signals from the acoustic test signal that are then produced by other loudspeaker boxes in the loudspeaker box arrangement as a basis for ascertaining a positional relationship between the signal-generating first loudspeaker box and at least one of the other loudspeaker boxes. By way of example, the evaluation device can evaluate the received signals or signals derived from the received signals for this purpose.

By way of example, the evaluation device may be designed to perform the ascertainment of the positional relationship on the basis of received signals obtained at audio signal outputs of an audio signal processing system. In this case, no additional (wired or wireless) signal inputs are needed for the received signals on the audio signal processing system, since the received signals can be tapped off from the audio signal outputs of the audio signal processing system.

The evaluation device may be configured to perform the ascertainment of the positional relationship on the basis of measured level values for the received signals. As already mentioned, the level meters required for this purpose, for example ammeters or voltmeters or wattmeters, may possibly already be present in the audio signal processing system, so that the evaluation merely requires resorting to measured values that are already present in the audio signal processing system. In combination with or in addition to the level measurement, the evaluation device may also be configured to perform the ascertainment of the positional relationship on the basis of measured propagation-time values for the received signals.

The device for identifying the position may additionally include an association device that is configured to make an association between logical addresses for a multichannel audio signal processing device and the loudspeaker boxes in accordance with the identified positions of the loudspeaker boxes in the loudspeaker box arrangement. By way of example, an existing association between the channels of the audio signal processing item and the positions of the loudspeaker boxes in the loudspeaker box arrangement can be checked and/or changed or corrected. The association device may additionally be configured to supply the channels of the multichannel audio signal processing device with their associated transfer functions, particularly filter coefficient sets, in line with the association found.

A computer program product for identifying the position of loudspeaker boxes in a loudspeaker box arrangement can comprise a program for bringing about a test mode for a first loudspeaker box in the loudspeaker box arrangement by emitting an acoustic test signal, and a program for evaluating received signals from the acoustic test signal that are then obtained from other loudspeaker boxes in the loudspeaker box arrangement, in order to ascertain a positional relationship between the signal-generating first loudspeaker box and at least one of the other loudspeaker boxes in the loudspeaker box arrangement.

If it is possible for both the production of test signals for bringing about the test mode and the evaluation of the received signals to be performed using signal generators or meters that are already present in conventional audio signal processing systems, then it is possible for existing audio signal processing systems to be operated or reconfigured solely by virtue of additional software control by means of the computer program product (e.g. an application program, a firmware update, etc.), i.e. e.g. to be coupled to or provided with the device for identifying the position of loudspeaker boxes. In addition, the audio signal processing system operated or reconfigured according to the embodiments described herein may be suitable for being combined with "system-extraneous" loudspeaker box arrangements, since successful identification of the position of the loudspeaker boxes in such loudspeaker box arrangements requires no kind of (additional) reciprocal adjustments between the audio signal processing system and the loudspeaker box arrangement.

An audio signal processing system according to one exemplary embodiment can include an audio signal processing item comprising multiple channels, wherein each channel of the audio signal processing item has one or more particular associated or associable loudspeaker boxes in a loudspeaker box arrangement. In addition, the audio signal processing system can include a device for identifying the position of loudspeaker boxes in the loudspeaker box arrangement, including a device for bringing about a test mode for a first loudspeaker box in the loudspeaker box arrangement by emitting an acoustic test signal, and an evaluation device that is configured to take received signals from the acoustic test signal that are then produced by other loudspeaker boxes in the loudspeaker box arrangement as a basis for ascertaining a positional relationship between the signal-generating first loudspeaker box and at least one of the other loudspeaker boxes.

As described in even greater detail below, the audio signal processing item comprising multiple channels may be implemented centrally in a single power amplifier device, in a local distribution over multiple power amplifier devices and, in this case, particularly also in a local arrangement in the individual loudspeaker boxes (known as "self-powered" boxes), for example.

Terms such as "connected" and/or "coupled" that are used below do not mean that the elements "connected" or "coupled" to one another must be connected to one another directly; interposed elements may be provided between the "connected" or "coupled" elements if need be. However, the disclosure content of the present document is also intended to cover the possibility of connected or coupled elements of this kind being connected or coupled to one another directly, i.e. without interposed elements. The same principles apply to the interpretation of the drawings, i.e. a direct line connection shown between two elements does not preclude the presence of elements arranged therebetween, but also covers the specific disclosure of a connection without elements situated therebetween.

FIG. 1 shows an exemplary device 100 for identifying the position of loudspeaker boxes in a loudspeaker box arrangement LSA. The device 100 for identifying the position can comprise a device 110 for bringing about a test mode for a first loudspeaker box by emitting an acoustic test signal and an evaluation device 120.

The loudspeaker box arrangement (also referred to as a loudspeaker box array or loudspeaker box group) LSA has a plurality n of loudspeaker boxes (LS). By way of example, the n loudspeaker boxes may be contained at n loudspeaker box positions LSP1, LSP2, . . . , LSPn in the loudspeaker box arrangement LSA.

A loudspeaker box arrangement LSA is a three-dimensional (for example vertical or horizontal) arrangement of often identical loudspeaker boxes that, by way of example, are capable of forming a common coherent wavefront. By way of example, a loudspeaker box arrangement LSA can consist of between four and twenty four loudspeaker boxes, but loudspeaker box arrangements having fewer or more loudspeaker boxes are also possible. By way of example, the loudspeaker boxes may be connected to one another mechanically. A specific example of a loudspeaker box arrangement LSA is what is known as a line array, in which the individual loudspeaker boxes are oriented below one another in a vertical orientation and are connected to one another mechanically, with a specific curvature of the line array being able to be set.

Conventionally, loudspeaker box arrangements LSA are frequently operated with identical audio signals, each loudspeaker box in the loudspeaker box arrangement LSA having the same associated transfer function for an audio signal processing item.

A modern approach involves the loudspeakers in the individual loudspeaker boxes being operated with individual input signals on the basis of their positions. As a result, every single loudspeaker box (or subgroup of loudspeaker boxes) is provided with its own transfer function. This allows optimum shaping of the sound level distribution in the target region (audience area) in accordance with the requirements of the respective event.

In this case, it is also possible to take into account the influence on the sound level distribution in the target region that is brought about by the mechanical orientation of the cabinets (for example curvature of the line array), for example, and for said sound level distribution to be specifically altered or improved electronically. Such systems are also known by the name "intelligent" line arrays. This requires knowledge of the physical position at which the respective loudspeaker box is located in the line array (or generally in the loudspeaker box arrangement LSA).

In this case, LSP1, LSP2, . . . , LSPn denotes the physical position of a loudspeaker box in the loudspeaker box arrangement LSA, i.e. LSP1 denotes the top loudspeaker box position in the loudspeaker box arrangement LSA, for example, LSP2 denotes the second loudspeaker box position from the top in the loudspeaker box arrangement LSA, for example, . . . , and LSPn denotes the bottom loudspeaker box position in the loudspeaker box arrangement LSA, for example.

In the exemplary illustration in FIG. 1, the device 110 for bringing about a test mode for a first loudspeaker box allows an acoustic test signal to be emitted by one of the loudspeaker boxes. By way of example, a particular loudspeaker box—as illustrated by the solid line 110_1—is addressed to present the acoustic test signal AT1. In FIG. 1, this is the loudspeaker box at the loudspeaker box position LSP1, for example, although the position of the addressed loudspeaker box may initially be unknown.

At the other loudspeaker boxes (in the example shown here, these are the loudspeaker boxes at the positions LSP2, . . . , LSPn), the acoustic test signal AT1 is received. Corresponding received signals E2, . . . , En are made available by the other loudspeaker boxes. The other loudspeaker boxes thus act as acoustic signal pickups (receivers) for the acoustic test signal AT1 emitted as a sound wave by the loudspeaker box that is operated in test mode.

The received signals E2, . . . , En provided by the loudspeaker boxes at the other loudspeaker box positions LSP2, . . . , LSPn can be produced at the loudspeaker boxes in different ways. One particularly simple option is for the received signals E2, . . . , En to be produced by the loudspeakers themselves by using the (dynamic) loudspeakers in the loudspeaker boxes as microphones and using the signal produced at the loudspeaker connections by the received sound—or a signal derived therefrom—as received signal E2, . . . , En.

The evaluation device 120 may be configured to take the received signals E2, . . . , En as a basis for ascertaining a positional relationship between the signal-generating first loudspeaker box (in the present example at the position LSP1) and at least one of the other loudspeaker boxes (in the present example at the positions LSP2, . . . , LSPn).

For this purpose, the evaluation device 120 can accept the received signals E2, . . . , En or signals dependent on or derived from the received signals E2, . . . , En, such as detection signals or measured detection values, for example, and can evaluate said signals for the purpose of ascertaining a positional relationship between the signal-generating loudspeaker box and at least one of the other loudspeaker boxes in the loudspeaker box arrangement LSA. The signals (e.g. received or detection signals) used for this purpose by the evaluation device 120 are denoted by IN1, IN2, . . . , INn in FIG. 1, where INk, k=1, . . . , n, can denote a signal that is identical to the received signal Ek or a signal that is dependent on or derived from the received signal Ek. Furthermore, the evaluation device 120 is notified, e.g. by a data interface IF of the device 110 for bringing about a test mode for the loudspeaker box(es), of which loudspeaker box (in this case, by way of example: the loudspeaker box at the position LSP1) is currently operated as a test sound signal generator. Naturally, the flow control (test mode, evaluation, etc.) can also be performed by a control unit (not shown) that is connected to the devices 110 for bringing about a test mode for the loudspeaker box(es) and to the evaluation device 120, e.g. via a databus, and controls said devices.

The evaluation device 120 can then take the signal-generating loudspeaker box for which notification has been provided via the data interface IF (or via the control unit) and the signals IN2, . . . INn tracing back to the received signals from the other loudspeaker boxes, for example, as a basis for ascertaining a positional relationship between the signal-generating first loudspeaker box and at least one of the other loudspeaker boxes. Further positional relationships can be ascertained in a similar manner between a second loudspeaker box (which is arranged e.g. at the position LSP2) and loudspeaker boxes that are different than this loudspeaker box (which are then situated e.g. at the positions LSP1, LSP3, . . . , LSPn). By way of example, for this purpose—illustrated by the dashed line 110_2—the second loudspeaker box (arranged e.g. in the loudspeaker box position LSP2) is addressed to present an acoustic test signal (not shown). The received signals E1, E3, . . . , En that are then produced by the other loudspeaker boxes at the positions LPS1, LPS3, . . . , LPSn are then used in the manner already described to ascertain the further positional relationship. For this purpose, the evaluation device can use the signals IN1, IN3, . . . , INn derived from the received signals E1, E3, . . . , En.

The ascertainment of the (relative) positional relationships between the loudspeaker boxes can be continued in the manner described until a partial or complete order of the loudspeaker boxes in the loudspeaker box arrangement LSA has been ascertained.

The ascertainment of a partial order of the loudspeaker boxes results in knowledge K that involves knowledge, for at least one loudspeaker box LSk, of the neighboring loudspeaker box(es) LSn1(*k*) and/or LSn2(*k*) therefor in the loudspeaker box arrangement LSA. In this case, n1(*k*) and n2(*k*) denote the two neighbor index functions for the loudspeaker box LSk with the index k.

The ascertainment of a complete order of the loudspeaker boxes results in knowledge K that involves knowledge, for each loudspeaker box LSk, of the neighboring loudspeaker box(es) LSn1(*k*) and/or LSn2(*k*) therefor in the loudspeaker box arrangement LSA.

The ascertainment of a complete order of the loudspeaker boxes and the (optional) additional knowledge ZK of at least one absolute loudspeaker box position (e.g. the position LSP1 for the first loudspeaker box LS1) result in knowledge K that involves knowledge, for each loudspeaker box LSk, of the (absolute) loudspeaker box position LSPm(k) thereof. In this case, m(k) denotes an index function that indicates that the loudspeaker box LSk with the index k is situated at the loudspeaker box position LSPm(k) with the index m.

The device 100 described by way of example with reference to FIG. 1 and/or the corresponding method can be used to make an association between the channels of a multichannel audio signal processing item and the loudspeaker boxes LSk in line with their identified positions LSPm(k) in the loudspeaker box arrangement LSA. For this purpose, the knowledge K can be transmitted to an association device 130 of the device for ascertaining the position 100 that is configured to allocate a logical address for a signal processing item in a multichannel audio signal processing item to a particular loudspeaker box LSk in accordance with its identified position LSPm(k).

By way of example, it is identified that a particular loudspeaker box LSk is situated at the position LSPm(k) in the loudspeaker box arrangement. The logical address of that audio signal processing item that is provided for the operation of a loudspeaker box at the position LSPm is then ascertained. This logical address is then used in order to form the loudspeaker input signal that is needed by the loudspeaker in the particular loudspeaker box LSk, i.e. in order to equip the particular loudspeaker box LSk with the transfer function that is provided for it (in accordance with its now known position LSPm).

The device 100 for identifying the position of loudspeaker boxes in a loudspeaker box arrangement LSA may be implemented in many diverse ways in terms of design. By way of example, it may be implemented as a data processing device that is provided with the described functionality by a computer program. By way of example, the data processing device may be arranged within an audio signal processing system including a (central or local) multichannel audio signal processing item. In this case, the audio signal processing system can be equipped or upgraded with the device 100 for identifying the position e.g. by loading the computer program.

In this case, it is possible for the device 100 to be implemented in a computer, for example a personal computer (PC), that is operated with a piece of software (PC software) comprising a computer program and providing the computer with the described functionality. The computer or PC may be connected to the multichannel audio signal processing system (for example in accordance with the different variant embodiments described below) by wire or wirelessly via a data link, for example a network. The data link can be used to transmit a piece of information based on the identified positional relationship to the audio processing system. By way of example, the knowledge K obtained in the evaluation device 120 or a logical address for a set of coefficients or a transfer function for a signal processing item that is ascertained in the association device 130 or, by way of example, the set of coefficients or the transfer function itself can be transmitted to the audio signal processing system.

Figure 2:
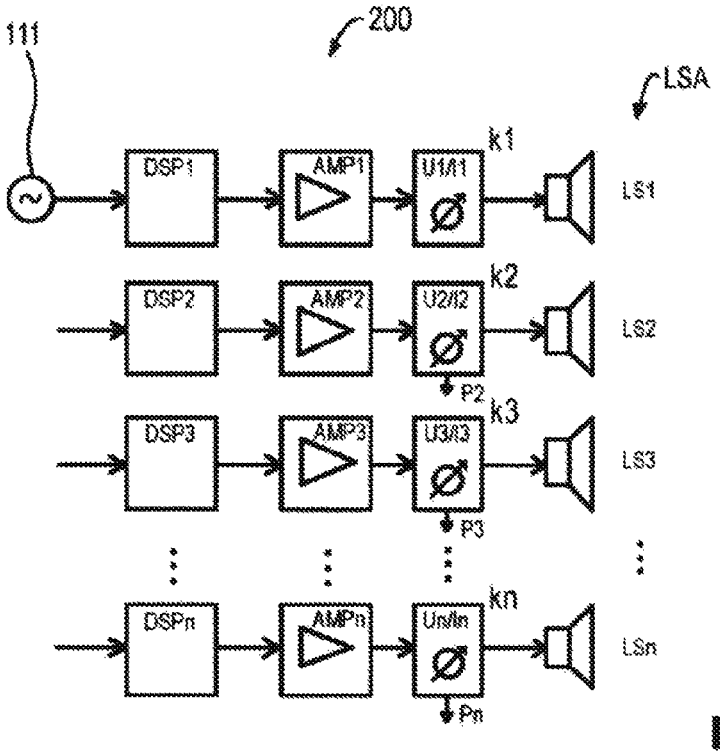
FIG. 2 schematically shows an exemplary audio signal processing system and provides an exemplary explanation of a method for identifying the position of loudspeaker boxes on the basis of a comparison of measured signal levels.

FIG. 2 shows an exemplary audio signal processing system 200 providing for multichannel audio signal processing. In the example shown, the audio signal processing has n channels K1, K2, . . . , Kn that each perform individual audio signal processing. By way of example, a particular channel Kk, k=1, . . . , n comprises channel-individual signal processing, which is implemented here by way of example in the form of a DSP (digital signal processor) with the designation DSPk. In addition, the channel Kk can include a power amplifier AMPk and (optionally) a level meter Uk/Ik, which is arranged at the power amplifier output, for example.

The channel-individual signal processing items allow the setting of an individual transfer function for each of the channels K1, K2, . . . , Kn. The signal processing items (e.g. DSPs) may be addressable via a network (for example Ethernet), which may be connected to the device 100, for example, in the manner described. By way of example, the individual transfer functions can be produced using FIR filters. The filter parameters (or DSP coefficient sets) can be ascertained and/or optimized in advance or during a test mode (e.g. calibration of the public address system). This is significant particularly for mobile public address systems, since these are used in different public address situations and therefore need to be set differently depending on the field of use. For this, i.e. for the computation and optimization of the channel-individual transfer functions, it is possible to use simulation programs that allow simulation of the entire public address system (audio signal processing system 200 and loudspeaker box arrangement LSA in combination with the respective acoustic properties of the audience area).

The level meters U1/I1, U2/I2, . . . , Un/In may each be connected to the audio signal inputs (loudspeaker connections) of the loudspeakers in the loudspeaker boxes LS1, LS2, . . . , LSn. Such level meters are already included in some conventional audio signal processing items, e.g. in order to allow channel-individual power measurement.

By way of example, the measured signal level P1, P2, . . . , Pn may be a voltage level, a power level or a current level, i.e. the level meters U1/I1, U2/I2, . . . , Un/In may accordingly be voltmeters, wattmeters and/or ammeters. Preferably, the low output impedance of the power amplifiers means that current level measurement is performed.

If the (dynamic) loudspeakers in the loudspeaker boxes LS1, LS2, . . . , LSn are used as receivers, the level meters U1/I1, U2/I2, . . . , Un/In can be used to measure the signal levels of the received signals E1, E2, . . . , En. If the received signals E1, E2, . . . , En are produced by microphones (not shown) in the loudspeaker boxes LS1, LS2, . . . , LSn, the received signals E1, E2, . . . , En can be detected by appropriate level meters (not shown), for example, which are connected to the connections of the microphones in the loudspeaker boxes LS1, LS2, . . . , LSn.

The measured signal levels (level values) P1, P2, . . . , Pn (detection signals) can be provided and evaluated as input signals IN1, IN2, . . . , INn in the evaluation device 120. On the basis of the measured signal levels P1, P2, . . . , Pn, the evaluation device 120 can perform the identification of the position of loudspeaker boxes in the loudspeaker box arrangement LSA.

To ascertain the loudspeaker box positions LSP1, LSP2, . . . , LSPn in the loudspeaker box arrangement LSA using the schematically shown audio signal processing system 200, the loudspeaker box LS1 that is situated at an unknown position LSPm(1) can be operated as a test signal sound source in the example shown. The remaining loudspeaker boxes LS2, LS3, . . . , LSn or at least some of them are operated as receivers. The received signals produced by the loudspeaker boxes LS2, LS3, . . . , LSn operated as receivers are measured in order to determine the measured level values P2, P3, . . . , Pn.

To produce the acoustic test signal by means of the loudspeaker box LS1, a signal generator 111 is shown by way of example, said signal generator producing a test signal that can be selectively applied to one (or if need be more) of the inputs of the channels K1, K2, . . . , Kn. In the exemplary embodiment shown in FIG. 1, the test signal produced by the signal generator 111 is connected to an audio signal input of the first channel K1, for example, while the other channels K2, . . . , Kn do not have the test signal applied to them. This is one of many options for how the device 110 for bringing about a test mode for a loudspeaker box (in this case: LS1) may be embodied.

The measured level values P2, P3, . . . , Pn transmitted to the evaluation device 120 are then compared in the evaluation device 120. From a comparison of the measured levels P2, P3, . . . , Pn, it is possible to infer the position of the relevant (receiving) loudspeaker box LS2, LS3, . . . , LSn in relation to the signal-generating loudspeaker box LS1 in the manner already described. The higher the level P2, P3, . . . , Pn, the closer the relevant loudspeaker box LS2, LS3, . . . , LSn is situated to the signal-generating loudspeaker box LS1. Two almost identical, maximum levels denote the two neighboring loudspeaker boxes, for example.

By way of example, after the method has been performed, it is established that the loudspeaker boxes LSk, k=1, . . . , n are arranged at the positions LSPk, with the exception of the loudspeaker boxes LS2 and LS3, which are situated at the positions LSP3 and LSP2, respectively.

This knowledge K can be transmitted to the association device 130. This association device can then ascertain the logical address of a set of coefficients or of a transfer function that is provided for the operation of the loudspeaker box at the position LSP3. This logical address is then used in order to form the loudspeaker input signal that is needed by the loudspeaker in the loudspeaker box LS2, i.e. in order to equip the loudspeaker box LS2 with the transfer function that is provided for it (in accordance with its now known position LSP3).

By way of example, this can be effected by virtue of the DSP2 of the channel K2 that is connected to the loudspeaker box LS2 now being operated with the set of DSP coefficients for the loudspeaker position LSP3 by means of reprogramming (and, conversely, the DSP3 of the channel K3 that is connected to the loudspeaker box LS3 can now be operated with the set of DSP coefficients for the loudspeaker position LSP2 by means of reprogramming). By way of example, it is thus possible for reprogramming of the signal processing to be performed in line with the function m(k), or, if need be, it is possible for cable connections or an association that exists in another way between the outputs of the channels K1, K2, . . . , Kn and the loudspeakers in the loudspeaker boxes LS1, LS2, . . . , LSn to be changed in line with the function m(k).

Figure 3:
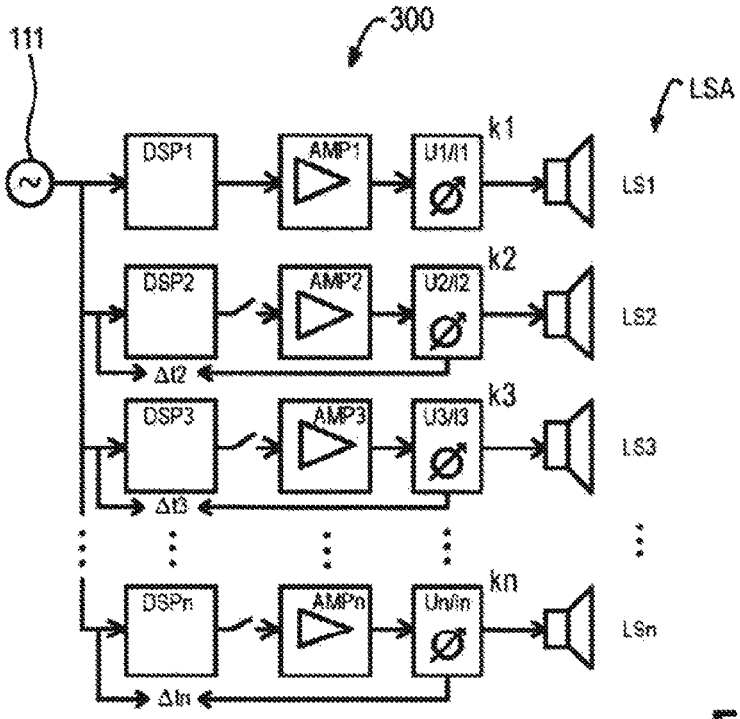
FIG. 3 schematically shows an exemplary audio signal processing system and provides an exemplary explanation of a method for identifying the position of loudspeaker boxes on the basis of a comparison of measured signal propagation times.

FIG. 3 uses a schematic block diagram illustration of an audio signal processing system 300 to explain a further option for evaluating received signals in order to determine the loudspeaker box positions LSP1, LSP2, . . . , LSPn of loudspeaker boxes LS1, LS2, . . . , LSn in the loudspeaker box arrangement LSA. In this case, the ascertainment of the loudspeaker box positions LSP1, LSP2, . . . , LSPn is based on a comparison of signal propagation times that the acoustic test signal has experienced between the sender (signal-generating loudspeaker box) and the respective receiver (one of the other loudspeaker boxes).

In turn, the first loudspeaker box LS1 is operated as a signal-generating loudspeaker box, while the other loudspeaker boxes LS2, LS3, . . . , LSn or a proportion thereof are used as receivers, for example (see FIG. 3). A propagation time for the individual loudspeaker boxes LS2, LS3, . . . , LSn is then ascertained from received signals E2, E3, . . . , En that arise at the other loudspeaker boxes LS2, LS3, . . . , LSn on account of the reception of the acoustic test signal AT1 from the signal-generating loudspeaker box LS1.

The propagation times, denoted here by Δt2, Δt3, . . . , Δtn, can be computed from the received signals E2, E3, . . . , En and the test signal emitted by the signal generator 111, for example. The computation can be performed by means of 2-channel FFT (Fast Fourier Transformation), for example, in the individual signal processing circuits, implemented here as DSP2, DSP3, . . . , DSPn, for example. Other possibilities for computing the propagation times likewise exist.

The production of the test signal by the signal generator 111 and the switch positions shown in FIG. 3 (which prescribe the channels to which the test signal is applied—in this case channel K1) can be performed and/or controlled or monitored by the device 110 for bringing about a test mode for the loudspeaker boxes. The computation of the propagation times can be performed and/or controlled or monitored by the evaluation device 120.

On the basis of the computed propagation times Δt2, Δt3, . . . , Δtn, it is likewise possible to infer the position of the associated loudspeaker box LS2, LS3, . . . , LS3*n* in the loudspeaker box arrangement LSA. The computed propagation times Δt2, Δt3, . . . , Δtn can be compared with one another. The longer the propagation time, the greater the distance of the respective loudspeaker box LS2, LS3, . . . , LSn from the signal-generating loudspeaker box LS1. Two almost identical, minimal propagation times denote the two neighboring loudspeaker boxes, for example. The comparison of the propagation times can be performed by the evaluation device 120.

Otherwise, to avoid repetition, reference is made to the description pertaining to FIGS. 1 and 2, which can be applied to the audio signal processing system 300 in analogous fashion.

There are many different options for how the audio signal processing of an audio signal processing system according to the description—for example the audio signal processing systems 200 and/or 300—can be carried out. Some options are cited below by way of example:

According to a first option, the multichannel audio signal processing (i.e. the channels K1, K2, . . . , Kn of the audio signal processing systems 200, 300) may be embodied centrally in a single, multichannel power amplifier device. In this case, the power amplifier device has n audio signal outputs, for example, which may be arranged on the output side of the power amplifiers AMP1, AMP2, . . . , AMPn and particularly also on the output side of the level meters U1/I1, U2/I2, . . . , Un/In. The n audio signal outputs of the power amplifier device may then be connected to the n loudspeaker inputs of the loudspeaker boxes LS1, . . . , LSn by means of suitable cabling. Each loudspeaker box LS1, . . . , LSn is supplied with a power-amplified, channel-individual audio signal.

According to a second option, the multichannel audio signal processing (i.e. the channels K1, K2, . . . , Kn of the audio signal processing systems 200, 300) may be embodied locally in multiple, for example in each case single-channel, power amplifier devices, which may be arranged in distributed fashion and, by way of example, at a distance from one another and which may be connected to the device for ascertaining the position 100, for example by means of data lines (e.g. a network such as Ethernet). These data lines can be used to supply the DSPs with their sets of coefficients/transfer functions too. In this case, the power amplifier devices may each have an audio signal output, for example, which may be arranged on the output side of the respective power amplifier AMP1, AMP2, . . . , AMPn and particularly also on the output side of the respective level meter U1/I1, U2/I2, . . . , Un/In.

The audio signal output of the respective power amplifier device may be connected to a loudspeaker input of one of the loudspeaker boxes LS1, . . . , LSn (or to the loudspeaker inputs of a subgroup of loudspeaker boxes) by means of suitable cabling. Each loudspeaker box LS1, . . . , LSn is supplied with a power-amplified, channel-individual audio signal in this case too.

According to a third and a fourth option, the multichannel audio signal processing (i.e. the channels K1, K2, . . . , Kn of the audio signal processing systems 200, 300) is embodied centrally or locally in accordance with the above description, where the power amplifiers AMP1, AMP2, . . . , AMPn and if need be also the level meters U1/I1, U2/I2, . . . , Un/In are situated in the individual loudspeaker boxes LS1, LS2, . . . , LSn. In these cases, the channel-individual signal processing items (e.g. DSP1, DSP2, . . . , DSPn) may be implemented in a shared signal processing item or in distributed signal processing items that are connected to the device for ascertaining the position 100, for example by means of data lines (e.g. a network such as Ethernet). These data lines can be used to supply the DSPs with their sets of coefficients/transfer functions too. The n audio signal outputs of the shared signal processing item or of the individual signal processing items, in a physically distributed arrangement, may be connected to the n loudspeaker inputs of the loudspeaker boxes LS1, LS2, . . . , LSn by means of suitable cabling or wirelessly. Each loudspeaker box LS1, LS2, . . . , LSn is supplied with a channel-individual audio signal that has not yet been power-amplified. The power amplification and the level measurement can then be effected locally in each loudspeaker box LS1, LS2, . . . , LSn.

According to a fifth option, the multichannel audio signal processing (i.e. the channels K1, K2, . . . , Kn of the audio signal processing systems 200, 300) may be embodied locally in the respective loudspeaker boxes LS1, LS2, . . . , LSn of the loudspeaker box arrangement. The loudspeaker boxes LSk may then each be equipped with a DSP (namely DSPk), a power amplifier AMP (namely AMPk) and particularly also a level meter Uk/Ik, for example. In this case, all of the loudspeaker boxes LS1, LS2, . . . , LSn in the loudspeaker box arrangement LSA can be supplied with the same audio signal (i.e. with the same input signal), the channel-individual signal processing first being effected locally in the individual loudspeaker boxes LS1, LS2, . . . , LSn.

The loudspeaker boxes LS1, LS2, . . . , LSn may be connected to the device for ascertaining the position 100, for example by means of data lines (e.g. a network such as Ethernet). These data lines can be used to supply the DSPs in the individual loudspeaker boxes with their sets of coefficients/transfer functions too.

In general, it is true that if transposition has occurred in the association between audio signal outputs and loudspeaker box inputs, this transposition can be corrected by means of an appropriate change in the logical addressing of the signal processing items (or channels) and/or—at least for the first 4 options, in which the loudspeaker boxes are supplied with channel-individual audio signals—an appropriate change in the cabling/other association.

In general, it is additionally true that the number of channels or signal processing items does not have to be identical to the number n of loudspeaker boxes or loudspeaker box positions. By way of example, multiple loudspeaker boxes can be operated with the same signal processing item, i.e. each channel may include two or more associated adjacent loudspeaker boxes, for example. By way of example, there may be e.g. always nx (adjacent) loudspeaker boxes provided per channel or signal processing item, for example nx=2, 3, . . . . The loudspeaker arrangement LSA then consists of subgroups of loudspeaker boxes that are each operated with the same signal processing item, i.e. whose loudspeakers are provided with the same audio signal. All of the methods, devices, computer programs, audio signal processing systems, etc. described here are intended to apply analogously for such a system or can be applied to such a system by virtue of the loudspeaker boxes described above being replaced mutatis mutandis by such subgroups of loudspeaker boxes. To avoid unnecessary formalism, the example of an identical number n of loudspeaker boxes and signal processing items is considered below—as above already.

Figure 4:
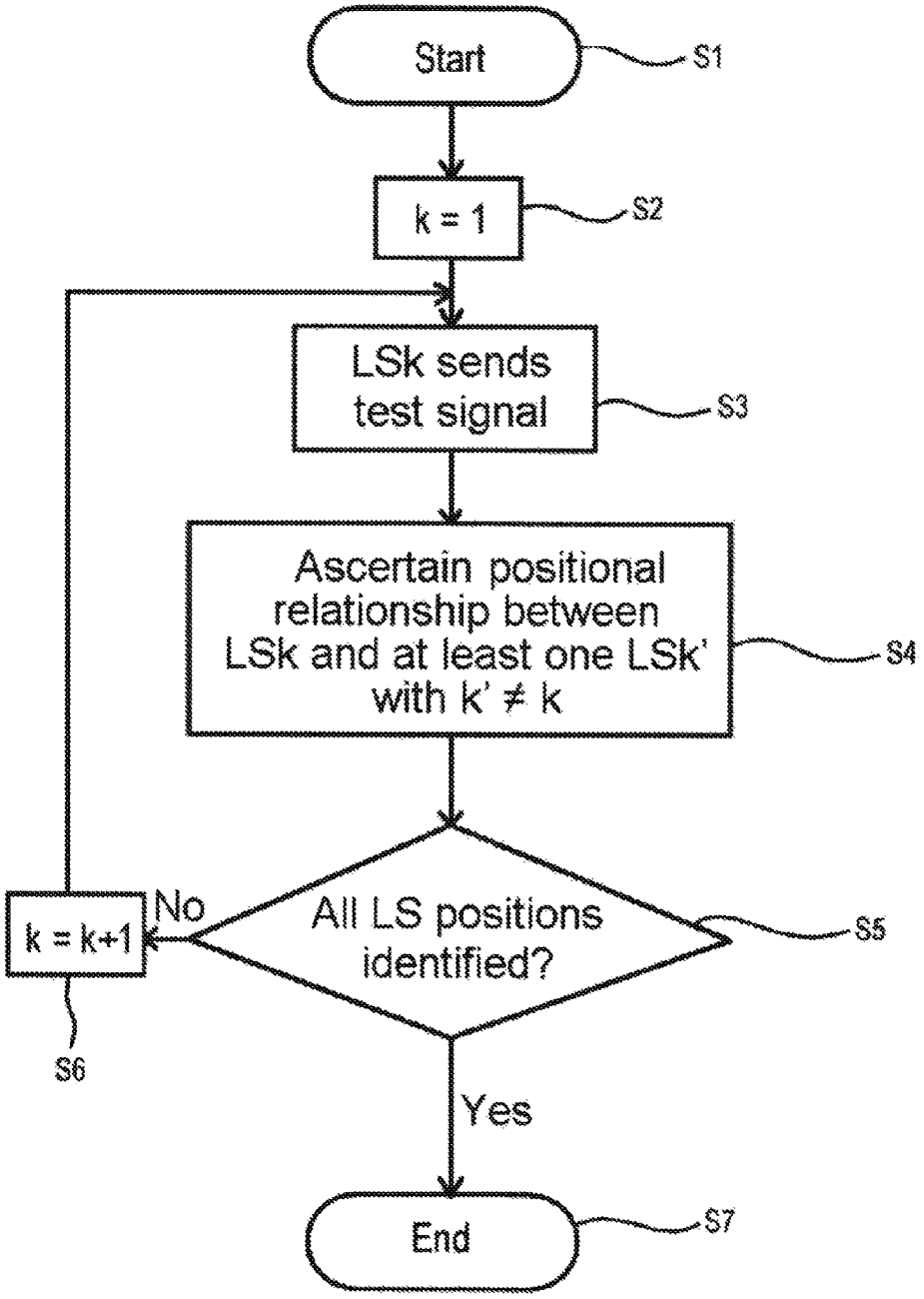
FIG. 4 is an exemplary flowchart to explain an exemplary embodiment of a method for identifying the position of loudspeaker boxes in a loudspeaker box arrangement.

The flowchart in FIG. 4 explains, in an exemplary manner, a possible method for identifying the position of loudspeaker boxes in a loudspeaker box arrangement LSA. The method begins with S1 (Start).

Next, the variable k=1 is set at S2.

Next, the loudspeaker box LSk transmits an acoustic test signal (S3). The transmission of the acoustic test signal can be controlled by a program for bringing about a test mode for a first loudspeaker box in the loudspeaker box arrangement.

Some or all of the other loudspeaker boxes receive the acoustic test signal. In S4, a positional relationship between the signal-generating loudspeaker box LSk and at least one other loudspeaker box LSk', where k'≠k, is ascertained. The ascertainment of the positional relationship can be controlled by a program for evaluating the received signals obtained from the other loudspeaker boxes in the loudspeaker box arrangement.

In S5, a check is performed to determine whether all loudspeaker box positions or positional relationships that are needed for the respective task have been identified.

If this is not the case, the variable k is incremented at S6, i.e. a different loudspeaker box is selected as a signal-generating loudspeaker box. Steps S3 to S6 are then performed repeatedly until all of the required loudspeaker box positions (or the order of some or all of the loudspeaker boxes in the loudspeaker box arrangement) have been identified. The method can then be terminated, for example (at S7).

The method explained in FIG. 4 can be carried out with any of the devices for identifying the position that have been explained above, with any computer program and/or with any of the audio signal processing systems explained above, for example. The same applies to the exemplary methods explained with reference to FIGS. 5 and 6 below.

Figure 5:
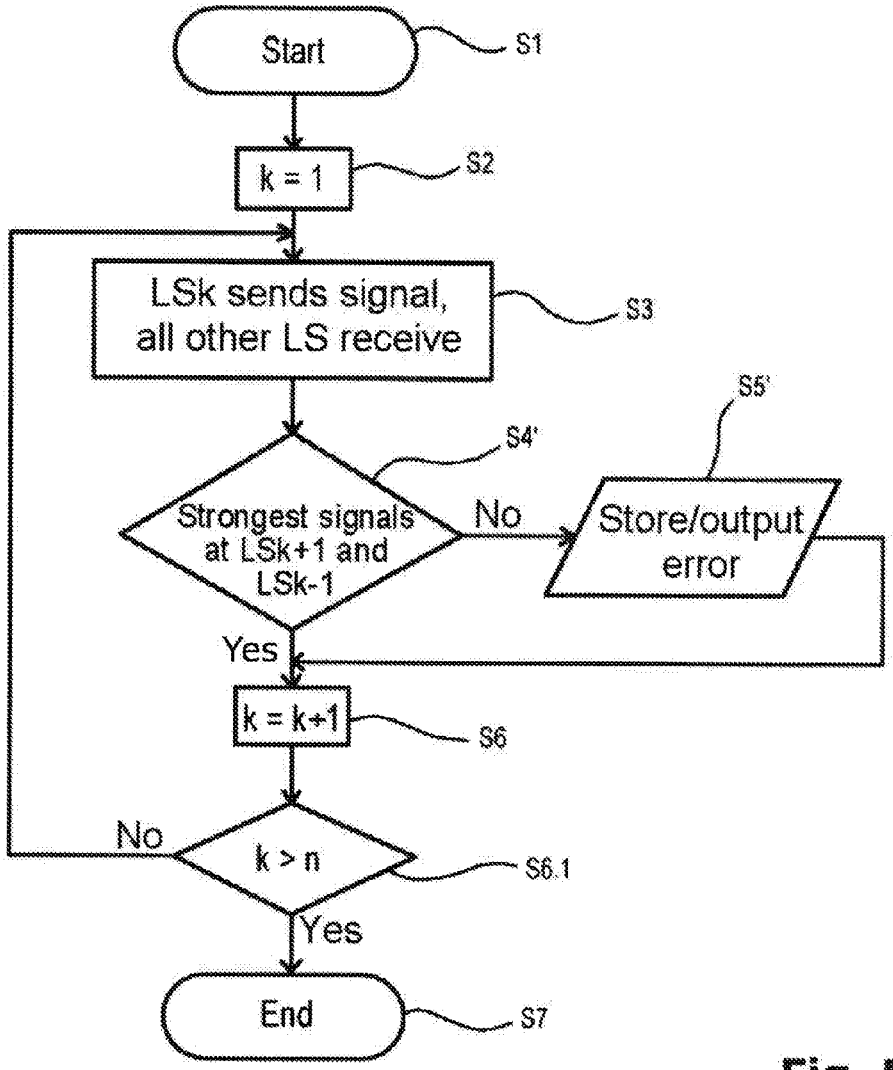
FIG. 5 is an exemplary flowchart for inspecting the order of loudspeaker boxes in a loudspeaker box arrangement.

FIG. 5 illustrates a further method variant, with combinations of this method variant with the exemplary method shown in FIG. 4 being possible.

Steps S1 to S3 can correspond to steps S1 to S3 shown in FIG. 4.

At S4', a check is performed to determine whether the signal levels obtained from the loudspeaker boxes LSk+1 and LSk−1 are the strongest signal levels. The loudspeaker boxes LSk+1 and LSk−1 are the loudspeaker boxes that should be arranged adjacent to the signal-generating loudspeaker box LSk in accordance with the intended association between the channel-individual signal processing items and the loudspeaker box positions LSP1, LSP2, . . . , LSPn.

If it is established at S4' that the signal levels obtained from these loudspeaker boxes LSk+1 and LSk−1 are not the strongest signal levels, then it can be assumed that an error has occurred in the association of the signal processing items with the loudspeaker boxes in the loudspeaker box arrangement LSA (e.g. as a result of cable transposition, etc.). This error is stored and/or output at S5'.

The variable k is then incremented at S6. So long as k is less than the maximum number n of loudspeaker boxes LSn (see S6.1), the method is repeated by recursion. Otherwise, the method is terminated at S7 (earlier discontinuation than indicated by S6.1 likewise being possible if the position finding has already concluded earlier than at k=n).

The method explained with reference to FIG. 5 allows inspection of the order of the loudspeaker boxes LS1, LS2, . . . , LSn in the loudspeaker box arrangement LSA. If an error in the association between the signal processing items or channels K1, K2, . . . , Kn and the (ascertained) loudspeaker box positions LSP1, LSP2, . . . , LSPn is established at S5', this error can be corrected. This can be accomplished by means of the measures already cited (for example changing the cabling or changing the association between the transfer functions/sets of DSP coefficients and the loudspeaker boxes, e.g. by means of reprogramming), for example.

The method example shown in FIG. 5 has been explained on the basis of the comparison of measured level values (at S4') in order to ascertain the errors (at S5'). It goes without saying that the positional relationships or position errors in the loudspeaker box arrangement LSA can also be identified using the other options described here, for example using propagation time measurements.

Figure 6:
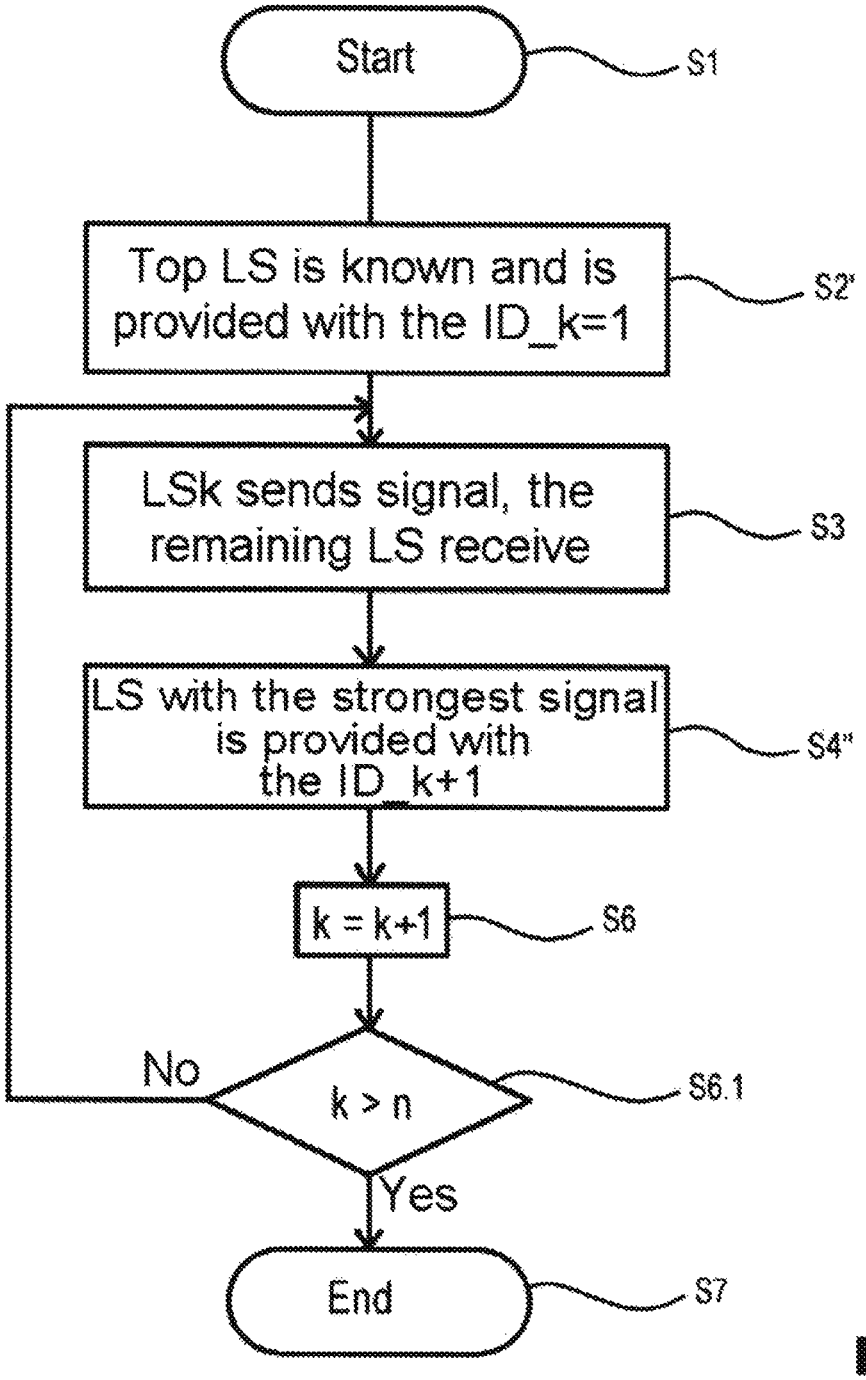
FIG. 6 is an exemplary flowchart to explain a method for determining the order of the loudspeaker boxes in a loudspeaker box arrangement and the allocation of logical addresses for the loudspeakers (or the channels or audio signal outputs of the audio signal processing system that operate the loudspeakers) on the basis of the ascertained order of the loudspeaker boxes.

FIG. 6 provides an exemplary explanation of a method for determining the order of the loudspeaker boxes LS1, LS2, . . . , LSn in the loudspeaker box arrangement LSA and/or for allocating logical addresses to loudspeaker boxes. The method presented in FIG. 6 can be combined in any way with the methods shown in FIGS. 4 and 5. In addition, the method shown by way of example in FIG. 6 again uses a comparison of measured level values to ascertain the positional relationships between the loudspeaker boxes in the loudspeaker box arrangement LSA, with—just as for the method shown in FIG. 5—other evaluation processes (for example evaluation by means of propagation time measurements) also being able to be used.

The method presented in FIG. 6 is used to determine the order of the loudspeaker boxes LS1, LS2, . . . , LSn in a line array and to allocate logical addresses to loudspeaker boxes for actuating this line array, for example. The method is based on a priori knowledge of the position of at least one loudspeaker box—in this case the loudspeaker box at the top position in the line array—for example. It goes without saying that such a priori knowledge may also exist for all other methods and can in this case allow the determination of absolute positions and/or reduce the number of recursions for ascertaining the complete knowledge of the loudspeaker box positions.

At S2', the loudspeaker box LS1 known to be situated at the top loudspeaker box position LSP1 in the line array is provided with the logical address ID_k=1.

At S3, this loudspeaker box LSk (that is to say initially LS1) is used as signal-generating loudspeaker box, while other, for example all of the remaining, loudspeaker boxes receive the acoustic test signal ATk (that is to say initially AT1).

At S4", that loudspeaker box that delivers the strongest received signal (the highest signal level) or—in the case of a propagation time measurement—the shortest signal propagation time is established. This loudspeaker box is provided with the logical address ID_k+1. The reason is that the loudspeaker box that delivers the strongest received signal (and/or the shortest propagation time) is the second loudspeaker box from the top (in general: the one situated directly beneath). It can be associated with the signal processing item that is intended for the second loudspeaker box position LSPk+1 from the top (in general: for the one situated directly beneath). To be more precise, the logical address ID_k+1 of this loudspeaker box can be associated with the logical address of that signal processing that is set up or programmed to perform signal processing item that is suitable for the loudspeaker box position LSPk+1 (or the DSP connected to the loudspeaker box having the address ID_k+1 is reprogrammed with the transfer function/set of DSP coefficients that is needed in accordance with the loudspeaker box position).

Next, steps S6, S6.1 and S7, which have already been described for FIG. 5, continue the recursions until the positions e.g. of all of the loudspeaker boxes in the line array (or generally in the loudspeaker arrangement LSA) are known. By way of example, in accordance with S6.1, this can involve each loudspeaker box LS1, LS2, . . . , LSn being operated once as a signal-generating loudspeaker box (earlier discontinuation in S6.1 e.g. for k=n may also be sufficient).

It is pointed out that a combination of the level measurement with the propagation time measurement can reduce the number (recursions) of measurements required. Furthermore, the measurement can also be rendered more failsafe if both measured variables are taken into consideration for the ascertainment of the loudspeaker box positions. Both measurement methods can be carried out either using microphones that are present on the loudspeaker boxes or without such microphones, i.e. solely with the loudspeakers acting as microphones in the loudspeaker boxes LS1, LS2, . . . , LSn. The level measurements or propagation time measurements can also be performed elsewhere in or on the channels K1, K2, . . . , Kn, for example, i.e. the specific options described here for level measurement and propagation time determination are merely exemplary.

The exemplary embodiments described here can be used both for loudspeaker boxes without a power supply and for active loudspeaker boxes or "self-powered" box systems with integrated signal processing. Invariably, determination of the positions of the loudspeaker boxes in a loudspeaker box array is performed on the basis of the simple concept of operating one of the loudspeaker boxes as a signal-generating loudspeaker box and using one or more of the other loudspeaker boxes as receiver(s) of the test sound signal emitted by the signal-generating loudspeaker box.

The invention claimed is:

1. A method for identifying an order of loudspeaker boxes in a loudspeaker box line array, comprising:

operating a first loudspeaker box in the loudspeaker box line array as an acoustic test signal generator;

receiving the acoustic test signal from the signal-generating first loudspeaker box at other loudspeaker boxes in the loudspeaker box line array; and ascertaining a positional relationship between the signal-generating first loudspeaker box and at least one of the other loudspeaker boxes in the loudspeaker box line array based on received signals from the acoustic test signal that are produced in the other loudspeaker boxes, wherein the received signals are subjected to a respective level measurement and the positional relationship between the signal-generating first loudspeaker box and the at least one of the other loudspeaker boxes is ascertained based on a comparison between the levels of the received signals from at least two other loudspeaker boxes.

2. The method of claim 1, wherein the loudspeakers in the other loudspeaker boxes are used as receivers of the acoustic test signal.

3. The method of claim 1, wherein the received acoustic test signal is subjected to a respective propagation time measurement and the positional relationship between the signal-generating first loudspeaker box and the at least one of the other loudspeaker boxes is ascertained on the basis of a comparison of the measured propagation times.

4. The method of claim 1, further comprising:

operating a second loudspeaker box in the loudspeaker box line array as an acoustic test signal generator, wherein the second loudspeaker box is different from the first loudspeaker box;

receiving the acoustic test signal from the signal-generating second loudspeaker box at other loudspeaker boxes in the loudspeaker box line array; and ascertaining a positional relationship between the signal-generating second loudspeaker box and at least one of the other loudspeaker boxes in the loudspeaker box line array on the basis of the acoustic test signal received in the other loudspeaker boxes.

5. The method of claim 1, further comprising:

allocating logical addresses for a multichannel audio signal processing item to the loudspeaker boxes in accordance with the identified positions of the loudspeaker boxes in the loudspeaker box line array.

6. The method of claim 1, wherein microphones in the other loudspeaker boxes are used as receivers of the acoustic test signal.

7. A device for identifying an order of loudspeaker boxes in a loudspeaker box line array, comprising:

a device for operating a test mode for a first loudspeaker box in the loudspeaker box line array by emitting an acoustic test signal; and an evaluation device configured to ascertain a positional relationship between the signal-generating first loudspeaker box and at least one of other loudspeaker boxes in the loudspeaker box line array based on received signals from the acoustic test signal that are produced by the other loudspeaker boxes in the loudspeaker box line array, wherein the received signals are subjected to a respective level measurement and the positional relationship between the signal-generating first loudspeaker box and the at least one of the other loudspeaker boxes is ascertained based on a level comparison between the levels of the received signals from at least two other loudspeaker boxes.

8. The device of claim 7, wherein the evaluation device is configured to perform the ascertainment of the positional relationship on the basis of received signals produced at audio signal outputs of an audio signal processing system.

9. The device of claim 7, wherein the evaluation device is configured to perform the ascertainment of the positional relationship on the basis of measured propagation-time values for the received signals.

10. The device of claim 7, further comprising:

an association device that is configured to make an association between logical addresses for a multichannel audio signal processing item and the loudspeaker boxes in accordance with the identified positions of the loudspeaker boxes in the loudspeaker box line array.

11. A computer readable non-transitory product on which computer program instructions are stored which, when executed by a computer, causes the computer to perform a method for identifying an order of loudspeaker boxes in a loudspeaker box line array, the method comprising:

a program for bringing about a test mode for a first loudspeaker box in the loudspeaker box line array by emitting an acoustic test signal; and a program for comparing levels of received signals from the acoustic test signal that are then obtained from other loudspeaker boxes in the loudspeaker box line array, in order to ascertain a positional relationship between the signal-generating first loudspeaker box and at least one of the other loudspeaker boxes in the loudspeaker box line array.

12. An audio signal processing system, comprising:

an audio signal processing circuitry comprising multiple channels, wherein each channel of the audio signal processing circuitry is associated or associable with one or more loudspeaker boxes in a loudspeaker box line array; and a device for identifying an order of loudspeaker boxes in the loudspeaker box line array, comprising:

a test mode device for bringing about a test mode for a first loudspeaker box in the loudspeaker box line array by emitting an acoustic test signal, and an evaluation device that is configured to take received signals from the acoustic test signal that are produced by other loudspeaker boxes in the loudspeaker box line array as a basis for ascertaining a positional relationship between the signal-generating first loudspeaker box and at least one of the other loudspeaker boxes by subjecting the received signals to a respective level measurement and by comparing between the levels of the received signals from at least two other loudspeaker boxes.

* * * * *